US011028621B2

(12) United States Patent
Toran Poggio

(10) Patent No.: US 11,028,621 B2
(45) Date of Patent: Jun. 8, 2021

(54) SECURITY LOCK FOR VEHICLES

(71) Applicant: INDULOCKS CERRADURAS INDUSTRIALES SL, Madrid (ES)

(72) Inventor: Pedro Toran Poggio, Madrid (ES)

(73) Assignee: INDULOCKS CERRADURAS INSUSTRIALES SL, Madrid (ES)

( * ) Notice: Subject to any disclaimer, the term of this patent is extended or adjusted under 35 U.S.C. 154(b) by 303 days.

(21) Appl. No.: 16/098,369

(22) PCT Filed: Feb. 19, 2018

(86) PCT No.: PCT/ES2018/070113
§ 371 (c)(1),
(2) Date: Feb. 1, 2019

(87) PCT Pub. No.: WO2018/178431
PCT Pub. Date: Oct. 4, 2018

(65) Prior Publication Data

US 2019/0218830 A1 Jul. 18, 2019

(30) Foreign Application Priority Data

Mar. 29, 2017 (ES) ..... 201730556

(51) Int. Cl.
*E05B 77/44* (2014.01)
*E05B 15/02* (2006.01)
(Continued)

(52) U.S. Cl.
CPC ..... *E05B 77/44* (2013.01); *E05B 81/04* (2013.01); *E05B 83/12* (2013.01); *E05B 85/24* (2013.01);
(Continued)

(58) Field of Classification Search
CPC . E05C 19/00; E05C 19/18; E05C 3/34; E05C 7/04; E05C 3/40; E05C 3/28;
(Continued)

(56) References Cited

U.S. PATENT DOCUMENTS 441,674 A * 12/1890 Kubler
689,074 A 12/1901 Ferris
(Continued)

FOREIGN PATENT DOCUMENTS

DE 202004016760 U1 3/2006
GB 2227517 A 8/1990

OTHER PUBLICATIONS

Internet: https://www.facebook.com/photo.php?fbid=525676434294204&set=a.120553744806477.1073741828.100005555560684&type=3&theater, Indulocks Cerraduras, Cerradura Claos, Sep. 27, 2016, as retrieved on Nov. 1, 2018, p. 1.
(Continued)

*Primary Examiner* — Lloyd A Gall
(74) *Attorney, Agent, or Firm* — Hauptman Ham, LLP

(57) ABSTRACT

A security lock for vehicles, especially for the cargo compartments of lorries or vans, but also usable on other doors, uses a clamp having two halves or plates such that same hold a bolt, increasing the contact area in the event of a possible attack or leverage, and, if the surface of the vehicle becomes deformed, the two halves jam the bolt, further increasing security and reducing the possibility of opening. In the security lock, the system of inside opening by a cable is eliminated. Further, opening from the inside of the vehicle is performed by rotating a shaft or handle perpendicular to the surface of the vehicle, preventing the vehicle from being accessed from the outside.

5 Claims, 6 Drawing Sheets

Figure 1:
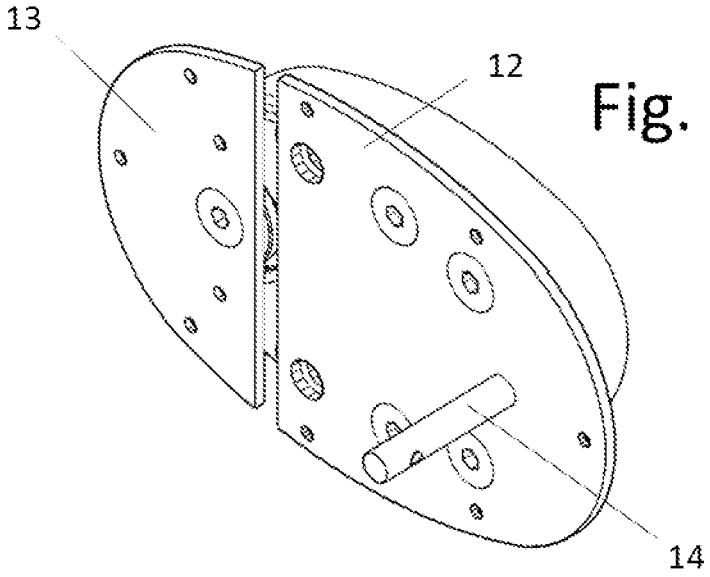

(51) Int. Cl.

| | |
|---|---|
| ***E05B 63/00*** | (2006.01) |
| ***E05C 19/18*** | (2006.01) |
| ***E05C 3/40*** | (2006.01) |
| ***E05C 3/28*** | (2006.01) |
| ***E05B 81/04*** | (2014.01) |
| ***E05B 85/24*** | (2014.01) |
| ***E05C 19/00*** | (2006.01) |
| ***E05B 83/12*** | (2014.01) |
| ***E05C 3/34*** | (2006.01) |

(52) U.S. Cl.
CPC ..... *E05C 3/34* (2013.01); *E05C 19/00* (2013.01); *E05C 19/18* (2013.01)

(58) Field of Classification Search
CPC . E05C 3/26; E05B 77/44; E05B 83/12; E05B 81/04; E05B 85/24; E05B 2015/0235; E05B 2063/0026
USPC .... 70/113–116, 121–123, 277, 278.2, 278.3, 70/278.7, 279.1, 280–282, 283.1; 292/44–49, 201
See application file for complete search history.

(56) References Cited

U.S. PATENT DOCUMENTS 1,334,852 A * 3/1920 Gorowitz ..... E05B 63/12 70/123
1,410,581 A * 3/1922 Langer ..... E05B 63/12 70/106
1,510,561 A * 10/1924 Segal ..... E05B 63/12 70/103
1,512,141 A * 10/1924 Segal ..... E05B 17/2088 70/106
1,563,914 A * 12/1925 Muzzio ..... E05B 63/12 70/123
1,810,760 A * 6/1931 Friedman ..... E05B 63/12 70/121
2,887,865 A * 5/1959 Moler ..... E05B 65/0858 70/149
3,601,434 A * 8/1971 Fargo ..... E05B 83/24 292/50
3,904,230 A * 9/1975 Fane ..... E05C 3/40 292/49
4,148,092 A * 4/1979 Martin ..... G07C 9/0069 361/172
4,312,527 A * 1/1982 Tannery ..... E05B 17/2088 292/197
4,641,868 A * 2/1987 Miron ..... E05B 15/04 292/336.3
4,745,785 A * 5/1988 Uebersax ..... E05B 47/0012 70/279.1
4,836,707 A * 6/1989 Myers ..... B25B 5/08 24/635
5,050,926 A * 9/1991 Tanaka ..... E05C 3/40 296/146.1
5,192,096 A * 3/1993 Weinerman ..... E05C 3/34 292/45
6,474,118 B2 * 11/2002 Martinez ..... E05B 63/0013 292/129
6,591,643 B1 * 7/2003 Cannella ..... E05B 47/0012 292/142
6,826,935 B2 * 12/2004 Gokcebay ..... G06K 19/04 340/5.2
7,497,103 B1 * 3/2009 Misner ..... E05B 63/14 292/129
9,797,162 B2 * 10/2017 Maguire ..... E05B 15/00
2011/0219830 A1 9/2011 Kaminsky, Jr.

OTHER PUBLICATIONS

International Search Report dated Jun. 7, 2018 from corresponding application No. PCT/ES2018/070113, pp. 1-3.

* cited by examiner

SECURITY LOCK FOR VEHICLES

FIELD OF INVENTION

This invention relates to a security locking device for vehicles, especially for the loading compartments of trucks or vans, but equally suited for other types of doors.

BACKGROUND ART

At present, there are different models in the security locking device market for industrial and commercial vehicles.

The latter tendency, by the desire of the users, is that the safety device automatically closes without the need to use the key. In order to achieve this, the universal solution is used, whereby a sliding latch enters into a groove made along the perimetral surface of a section of the bolt's side.

This type of solution presents two major flaws:

From the inside, the opening procedure is performed by pulling on a cable which, overcoming opposition from a local spring, withdraws the sliding latch, thus freeing the bolt once the latch leaves its groove. This method can be exploited by burglars, who could drill a hole into the body of the vehicle and by means of a specially designed tool grab and pull on the cable, opening the device.

Because the sliding latch is in contact with only a section of the bolt's side, if there were to be a deformation in this area, through it, the latch could escape from its groove, and the locking device would be opened.

BRIEF EXPLANATION OF THE INVENTION

The invention relates to a security locking device for vehicles, as specified in the "claims" section.

The closing mechanism uses a two halves clip or claws to grip the bolt increasing not only the contact surface upon a possible attack or leverage, but in the event of causing a deformation of the vehicle's surface, further increasing security and reducing the possibility of its opening.

This closure can improve the closing force and opening by the use of an individual spring for each of the clamp's jaws. This way, the movement of each one is independent from the other, and in order to open them, the force of each individual spring must be overcome.

By this invention, there is no longer need for a cable system when opening from inside. This process is now performed through the turning of a shaft or crank (perpendicularly to the vehicle's surface) that is inaccessible from the vehicle's exterior. This crank is made of metal or an alloy, and its end connects (directly or indirectly) to the actuator which shall be described further on.

Specifically, the security locking device for vehicles, has a protruding element which holds a gripping bolt, and is fixed to a moving surface (door). It also has a receiving element (on another moving surface or the door's frame) with a release lock. The bolt is such that it has a section of narrow perimeter, but it also possesses a cone or truncated-cone shaped head. On the other hand, the receiving element comprises a clamp with jaws which define a grip that surrounds all or most of the bolt's narrow section, when in the "closed" position. This clamp with jaws is opened with the lock by means of an actuator against one or more return springs. The clamp will also open when the bolt's head moves against the edge of the clamp's gripping area.

To impede exterior access to the lock mechanism, the clamp, actuator and bolt are located between two protective casings made from a sturdy material. The protruding element and the receiving element will be fixed to each of them, respectively.

The preferred actuator would be an eccentric plate located between the clamp's two halves, which would connect to a crank which performs an opening function from inside. This crank can be coaxial to the lock, or can be non-coaxial and connected mechanically to the actuator by means of connecting rods (whether they be parallel or crossed to one another). A second solution is for both the crank and the lock to have their own actuators. In this case, both actuators can follow the same principle, or differ in it.

The lock can be electronic, with or without wireless technology (for example, Bluetooth or NFC (Near Field Communications) technology). It could be controlled through a secure application on a smart cellular phone. Preferably, the lock will conserve a mechanical opening mechanism (with key), so that it be possible to open in any situation. A way to achieve this objective would be for the device to have two locks in parallel, one mechanical and the other electronic, with a common actuator, or with independent ones. This way, both will be capable of opening the clamp independently. The electronic lock could be hidden from sight.

FIGURE DESCRIPTIONS

For a better understanding of the invention, the following figures are included:

FIG. 1: It provides an exterior frontal view, in perspective, of an example of the device.

Figure 2:
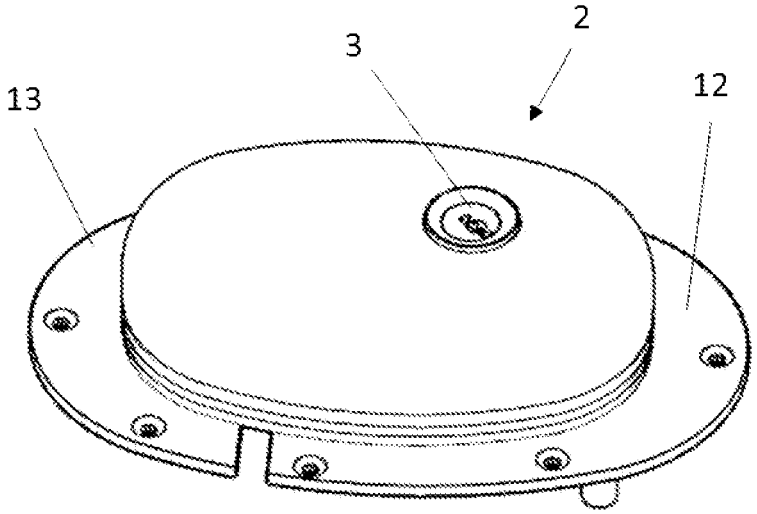

FIG. 2: It shows a back view of the previous example.

Figure 3:
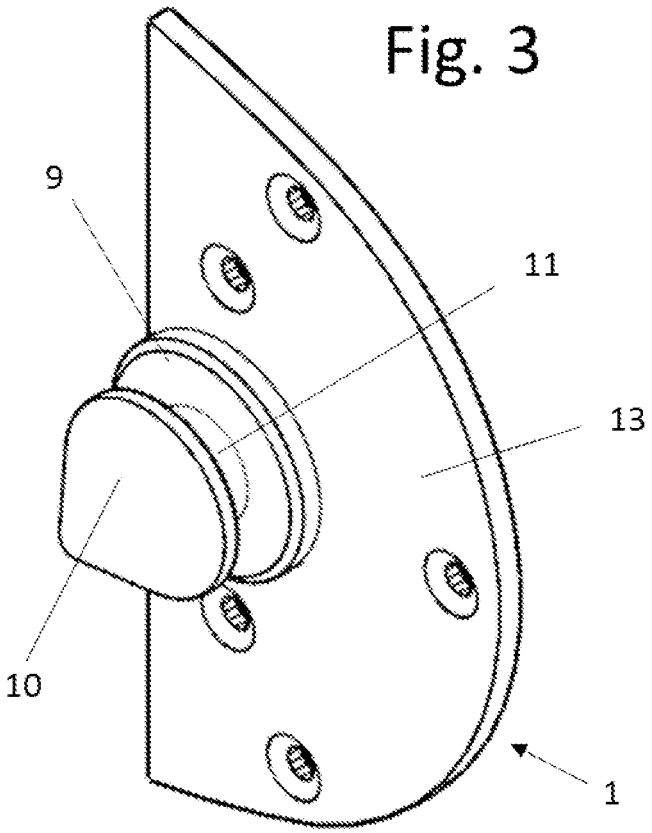

FIG. 3: It shows the protruding part from the example in FIGS. 1 and 2.

Figure 4:
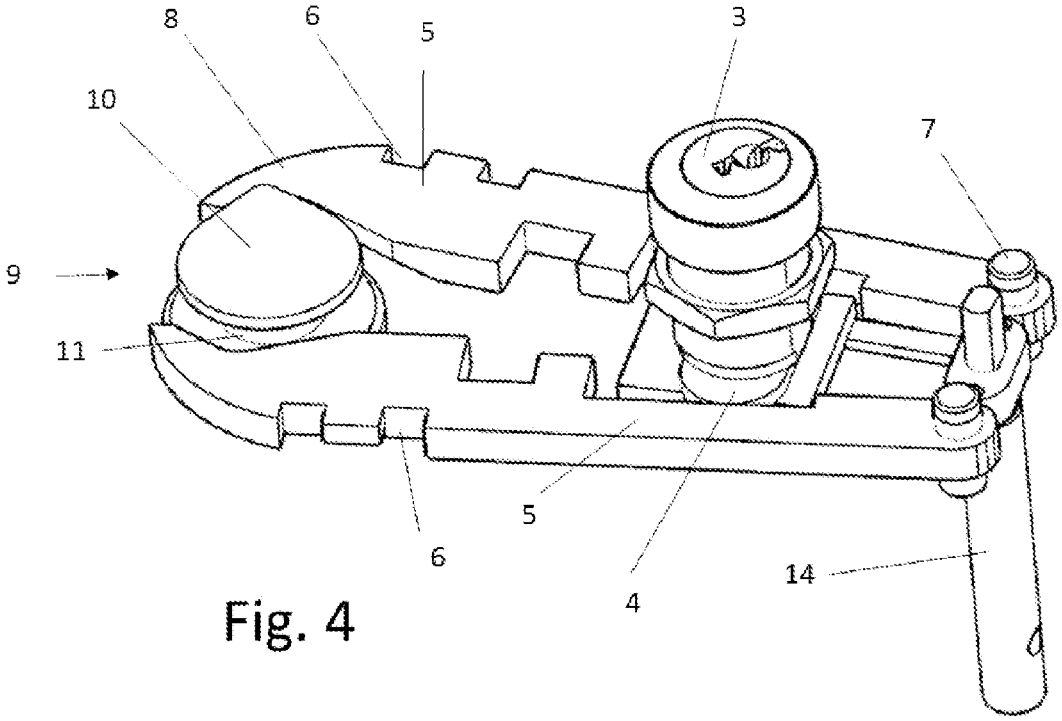

FIG. 4: It provides an assembly view of the clamp in an open position, without gripping the bolt.

Figure 5:
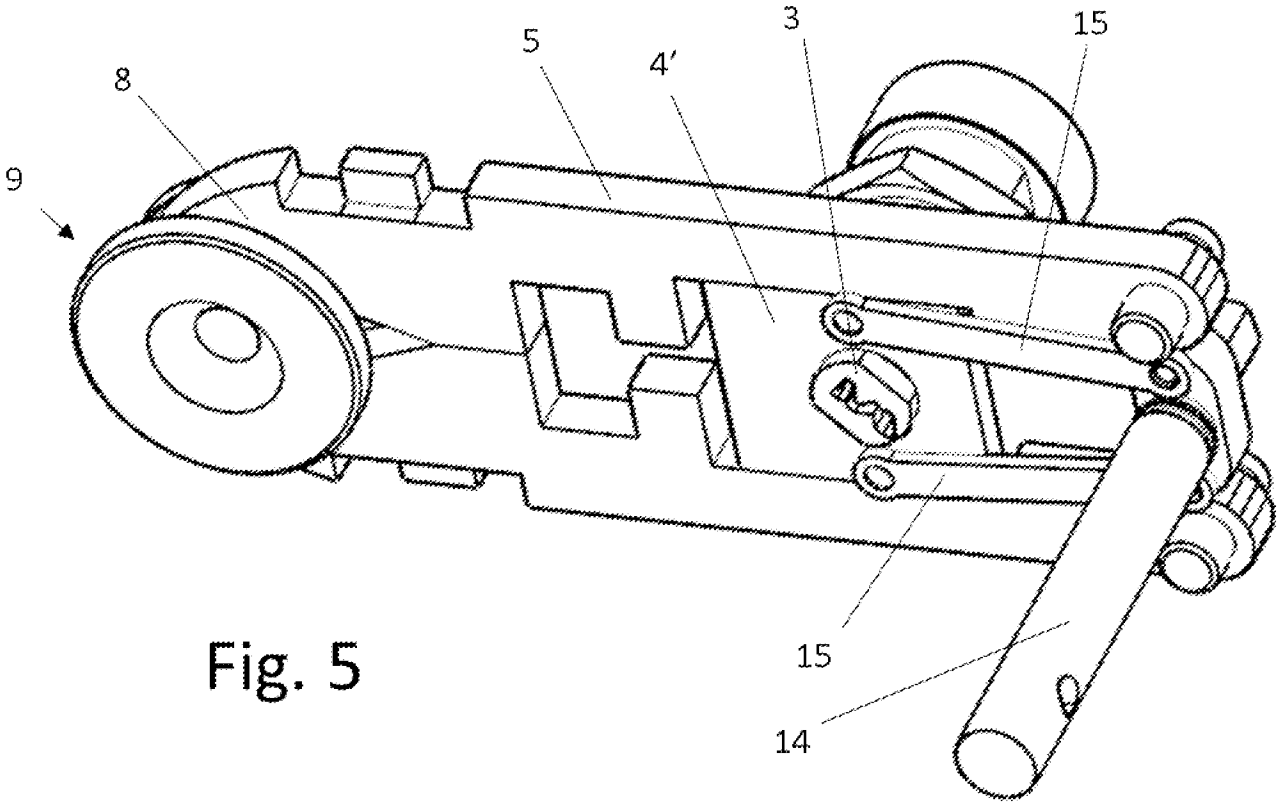

FIG. 5: It shows a view of the previous example from a different angle, but with the clamp closed around the bolt.

Figure 6:
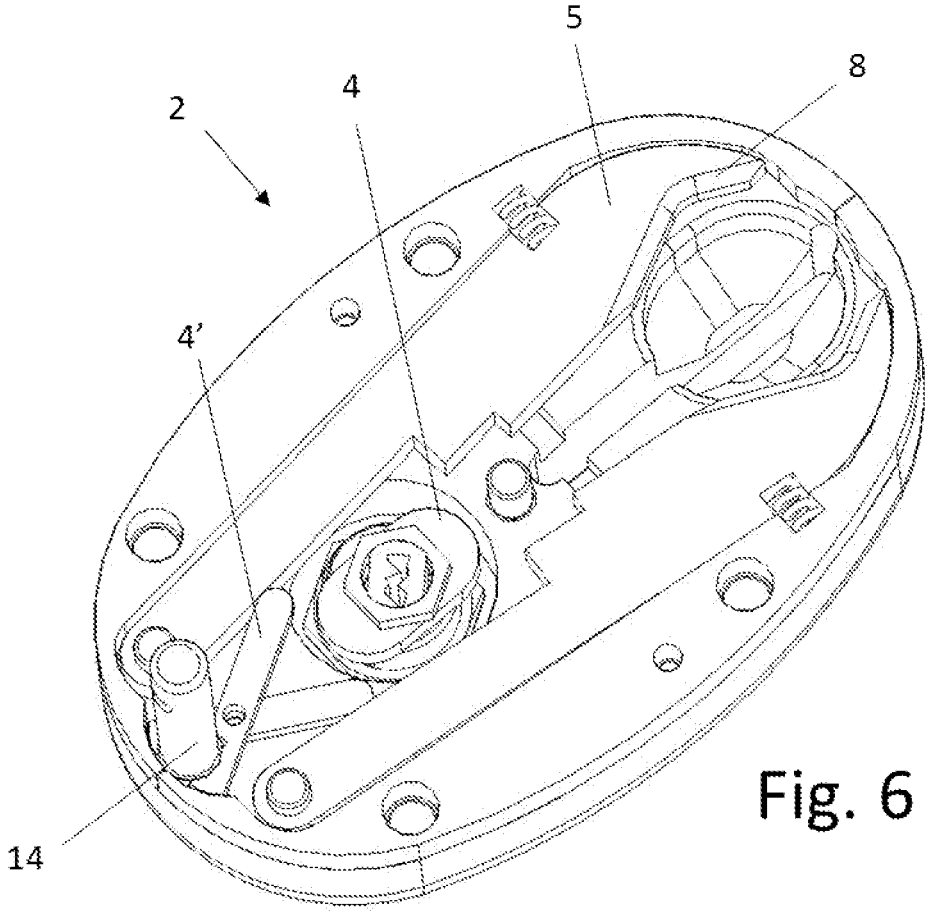

FIG. 6: It shows the assembly view of another example where the lock and the crank possess independent actuators.

Figure 7:
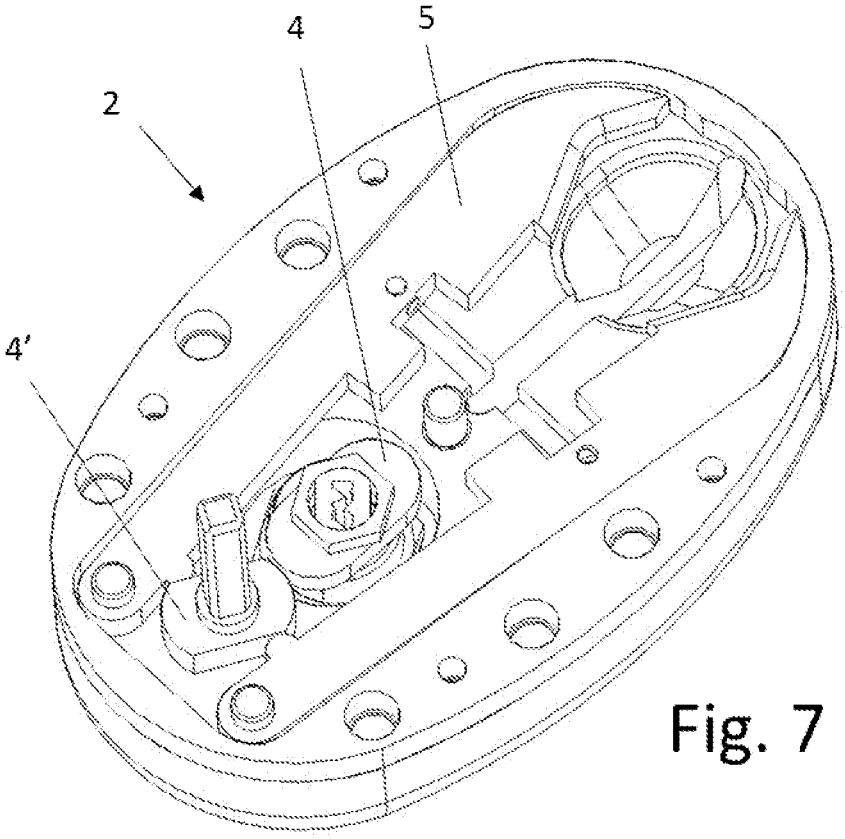

FIG. 7: It shows the assembly view of another example where the lock and the crank possess independent actuators

EMBODIMENTS OF THE INVENTION

In the following, one briefly describes an embodiment of the invention as an illustrative and not limited example of this.

The different embodiments shown in FIGS. 1-6 follow the same premise. The security locking device comprises two external elements. The first one will be fixed to a moving surface (hinged or sliding), and the other one to another surface or to some kind of frame, depending on the kind of door (one-fold, two-fold, sliding . . . ). The first element shall be called "protruding element" (1), and the second one will be the "receiving element" (2). Either of the two parts can be the one fixed to the moving surface, but usually preferably, it should be the receiving element (2). In this case, the protruding element (1) would stay immobile through the opening or closing process, although as has been mentioned, it can be on another moving surface and therefore be also mobile.

The receiving element (2) contains the cam lock (3), which will itself follow the usual security measures for this technology (anti-drill pins, uncopiable keys, etc.). The insertion of the key into the lock (3) and its turning shall produce a rotatory motion on an actuator (4) (which faces the vehicle's interior so as to not be accessible from the outside). This actuator (4) can take many shapes, as can be seen in the different examples represented, as long as its rotation causes the opening of the clamp (5), opposing one or more (traction or compression) springs (unreferenced). These springs shall be lodged in some notches (6) on the clamp's (5) side.

The clamp (5) shown in the figures is composed of two symmetric halves, each of which is articulated at a shaft (7) on its tip. On the other tip, they possess a curved jaw (8) in order to grip a bolt (9) fixed to the protruding element (1). Both the jaws (8) and the bolt (9) possess inclined surfaces, in order for the bolt's (9) movement to be able to separate the clamp's (5) two halves (pushing against the spring coils) so that it opens, and can then grip the bolt (9). For example, the bolt (9) will have a conical or truncated-cone head (10) and a narrow section (11). In the closed position, the clamp's jaws (8) surround all or most of the bolt's (9) narrow section (11). In this way, it is impossible for the bolt (9) to escape the clamp (5). If so desired, the narrow section (11) can also have an inclined surface so as to facilitate the opening of the clamp (5).

The bolt (9) can be formed out of only a single piece or out of several. For example, an element with a narrow section (11) and a head (10) which is fixed to a plate or casing by inner or outer threads.

To avoid access to the clamp (5) from the outside, the group formed by clamp (5), actuator (4) and bolt (9) is located between plates (12, 13) joined to the protruding and receiving elements (1, 2) respectively. These plates (12, 13) will be made from a resistant material, such as a tempered steel or something with similar properties. Preferably, there will be a plate on both sides of the elements, protecting them from any angle.

The preferred actuator (4), would be, due to its simplicity, an eccentric plate. Turning it causes the two halves of the clamp (5) to retract against the spring or springs.

For safety reasons, among others, it is necessary to permit the opening of the lock from the interior of the vehicle. For this purpose, a crank (14) is used, which can be coaxial to the lock (3), or not. When they are coaxial, the plate, which constitutes the preferred actuator (4), will be mechanically joined to both of them. Preferably by means of a differential, so that the crank's (14) rotation be independent from the lock's (3). In other words, the turning of the crank (14) will neither produce nor require any rotation on the lock's (3) part, and vice versa. Another way to obtain this result would be for the actuator to be comprised of two independent parts, each of which corresponding to one of the two aforementioned elements (lock or crank).

If the lock (3) and crank (14) are not coaxial, the actuator (4) can then be fixed to one of the two and joined to the other by the use of connecting rods (15). The connecting rods (15) can be approximately parallel if the lock (3) and the crank (14) have the same direction of rotation (FIG. 5). If what we wish is for them to have opposite direction of rotation, then the connecting rods (15) will cross.

An example can be seen in FIG. 6 where the crank (14) possesses its own second actuator (4'), which in this case is a scissor-type mechanism that multiplies the opening generated by the turning of the crank (14), which has a slight eccentricity.

Another example is shown in FIG. 7, where the crank (14) has its own second actuator (4'). In this case it is of smaller size and it coincides with two small projections on the clamp's (5) interior.

The invention claimed is:

1. A security locking device for a vehicle, the security locking device comprising:

a protruding element which holds a bolt, and a receiving element with a release lock, wherein the bolt possesses a conic or truncated-cone head and a narrow section, the receiving element comprises a clamp whose jaws define a grip that surrounds all or most of the bolt's narrow section, and which is configured to be opened by the lock by means of an actuator, the security locking device further comprises a crank configured for opening the clamp from an inside of the vehicle, the actuator is an eccentric plate located between two halves of the clamp, connected in rotation to the release lock and the crank, and the crank is not coaxial to the release lock, and is connected mechanically to the actuator by means of approximately parallel connecting rods.

2. The security locking device according to claim 1, wherein the clamp, the actuator and the bolt are all located between and joined respectively to the protruding element and the receiving element, the protruding element includes a first plate, the receiving element includes a second plate, and the first and second plates are made of a resistance material.

3. The security locking device according to claim 1, which comprises a second actuator connected to the crank in order to open the clamp.

4. A security locking device for a vehicle, the security locking device comprising:

a protruding element which holds a bolt, and a receiving element with a release lock, wherein the bolt possesses a conic or truncated-cone head and a narrow section, the receiving element comprises a clamp whose jaws define a grip that surrounds all or most of the bolt's narrow section, and which is configured to be opened by the lock by means of an actuator, the security locking device further comprises a crank configured for opening the clamp from an inside of the vehicle, the actuator is an eccentric plate located between two halves of the clamp, connected in rotation to the release lock and the crank, and the crank is not coaxial to the release lock, and is connected mechanically to the actuator by means of crossing connecting rods.

5. A security locking device for a vehicle, the security locking device comprising:

a protruding element which holds a bolt, and a receiving element with a release lock, wherein the bolt possesses a conic or truncated-cone head and a narrow section, the receiving element comprises a clamp whose jaws define a grip that surrounds all or most of the bolt's narrow section, and which is configured to be opened by the lock by means of an actuator, the security locking device further comprises a crank configured for opening the clamp from an inside of the vehicle, the security locking device further comprises a second actuator connected to the crank in order to open the clamp, and the second actuator is a scissor-type mechanism.

* * * * *